United States Patent [19]

Weiss

[11] Patent Number: 4,589,453

[45] Date of Patent: May 20, 1986

[54] CONTAINER FILLING DEVICE

[75] Inventor: Wilhelm Weiss, Regensburg, Fed. Rep. of Germany

[73] Assignee: Krones AG Hermann Kronseder Maschinenfabrik, Neutraubling, Fed. Rep. of Germany

[21] Appl. No.: 761,153

[22] Filed: Aug. 1, 1985

[30] Foreign Application Priority Data

Aug. 9, 1984 [DE] Fed. Rep. of Germany ..... 3429314

[51] Int. Cl.[4] ..... B65B 31/00

[52] U.S. Cl. ..... 141/39

[58] Field of Search ..... 141/6, 39, 40, 41

[56] References Cited

U.S. PATENT DOCUMENTS 2,617,575 11/1952 Mojonnier ..... 141/6

3,209,794 10/1965 Granier ..... 141/6 X

*Primary Examiner*—Stephen Marcus

*Assistant Examiner*—Mark Thronson

*Attorney, Agent, or Firm*—Fuller, House & Hohenfeldt

[57] ABSTRACT

In the containing filling device the tank for the liquid to be dispensed into containers has gas somewhat over atmospheric pressure applied to the liquids surface. Each filling station has an outlet leading to the container being filled, a gas valve coupling the tank to the container and a fluid valve coupling the tank to the conveyor. The liquid above the tip of the tube that leads from the gas valve is forced back into the tank by means of gas pressure injected into the outlet after the filling operation is ended. In which case the fluid valve is forced closed and the gas valve is forced open. Because of the forced open gas valve the injection of gas takes place at very low pressure differential, causing neither disturbance of the liquid in the container and in the tank nor blow out of liquid below the level of the tank of the gas return tube.

7 Claims, 3 Drawing Figures

CONTAINER FILLING DEVICE

BACKGROUND OF THE INVENTION

This invention pertains to improvements in counterpressure container filling devices.

In one known type of counterpressure filling device there is the conventional fluid valve and gas valve coupling a tank containing the liquid to a container such as a bottle which is to be filled. Upward movement of a control member arranged at the upper end of the return gas tube first releases the fluid valve so that if equal pressure in the tank and container prevails the valve will open automatically by a spring. Additional upward movement of the control member forcibly opens the gas valve. In the reverse case of downward movement of the control member the gas valve and then the fluid valve are forcibly closed. With this known container filling device it is not possible to simultaneously hold the fluid valve forcibly closed and the gas valve forcibly open.

To make it possible for the liquid and pressurizing gas that is expelled from the container to return during the end phase of the filling process the known container filling device provides the gas valve stem with a spring loaded back pressure valve that at a certain over pressure in the container being filled or in the return gas tube opens the path to the storage tank automatically. For this device, the over pressure of the gas supply relative to the pressure in the storage tank needs to be comparatively large in order to assure positive opening of the back pressure valve which acts as a choking restriction.

The pressure spike generated upon opening of the back-pressure valve thus causes a considerable disturbance of the liquid in the storage tank and in the container being filled. Disturbances can create problems, for example, they can cause an undesirable increase in oxygen absorption or release of carbon dioxide. Another problem is that filling height is not as precise as should be obtainable with a counterpressure system because more or less liquid below the level of the lower open end of the return gas tube is blown through the return gas tube and back into the tank.

Similar conditions prevail for other known container filling devices of this general prior art type which differ from the container filling device only in the design of the non-return stop valve as in U.S. Pat. No. 3,209,794.

In another known container filling device a gas valve with a hood-like valve body is located at the upper end of the return gas tube to control only the flow of the displaced pressurizing gas as the container is filled while another separately controlled valve pressurizes the container. This is illustrated in U.S. Pat. No. 2,617,575. The gas valve on the return gas tube is coupled with the forcibly-closable fluid valve in such a way that it is always opened when upon pressure equalization between tank and container the fluid value opens automatically by means of a spring. Closing of the gas valve upon forcibly closing the fluid valve is achieved solely by the weight of the hood-like valve body. The gas valve, thus, can not be forcibly closed or be kept forcibly closed. In the end phase of the filling operation the hood-like body acts as a back-pressure valve when gas is blown into the tank in order to remove any liquid that is higher than the lower tip or end of the return gas tube in the container. This known container filling device has the same inadequacies as the previously described devices.

SUMMARY OF THE INVENTION

An objective of the present invention is to significantly reduce the pressure differential between the storage tank and gas pressure source which is needed for displacement of liquid and gas through the return gas tube. Briefly stated, according to the invention, no back pressure valve or similar device needs to be opened by the pressure of the gas entering the tank in a container filling device. The displaced gas due to fluid filling can flow without impediment and without any significant throttling by way of the return gas tube through the forcibly opened gas valve into the container. Therefore, the pressure differential can be very low and needs to be only a little larger than the pressure due to the column of liquid in the return gas tube or, for example, on the order of 0.04 to 0.2 bar. Displacement of the liquid to the lower end of the return gas valve tube proceeds very gently and causes no disturbance in the tank nor in the container being filled. Also, there is no entrapment of liquid from below the intended filling level. Thus, the desired filling level is maintained unusually precise. Usage of gas under pressure is also low which turns out to be especially advantageous if inert gas such as carbon dioxide is used. The cost of back pressure valves in the filling device is also saved.

An embodiment of the invention will now be described in greater detail in reference to the drawings.

DESCRIPTION OF A PREFERRED EMBODIMENT

Figure 1:
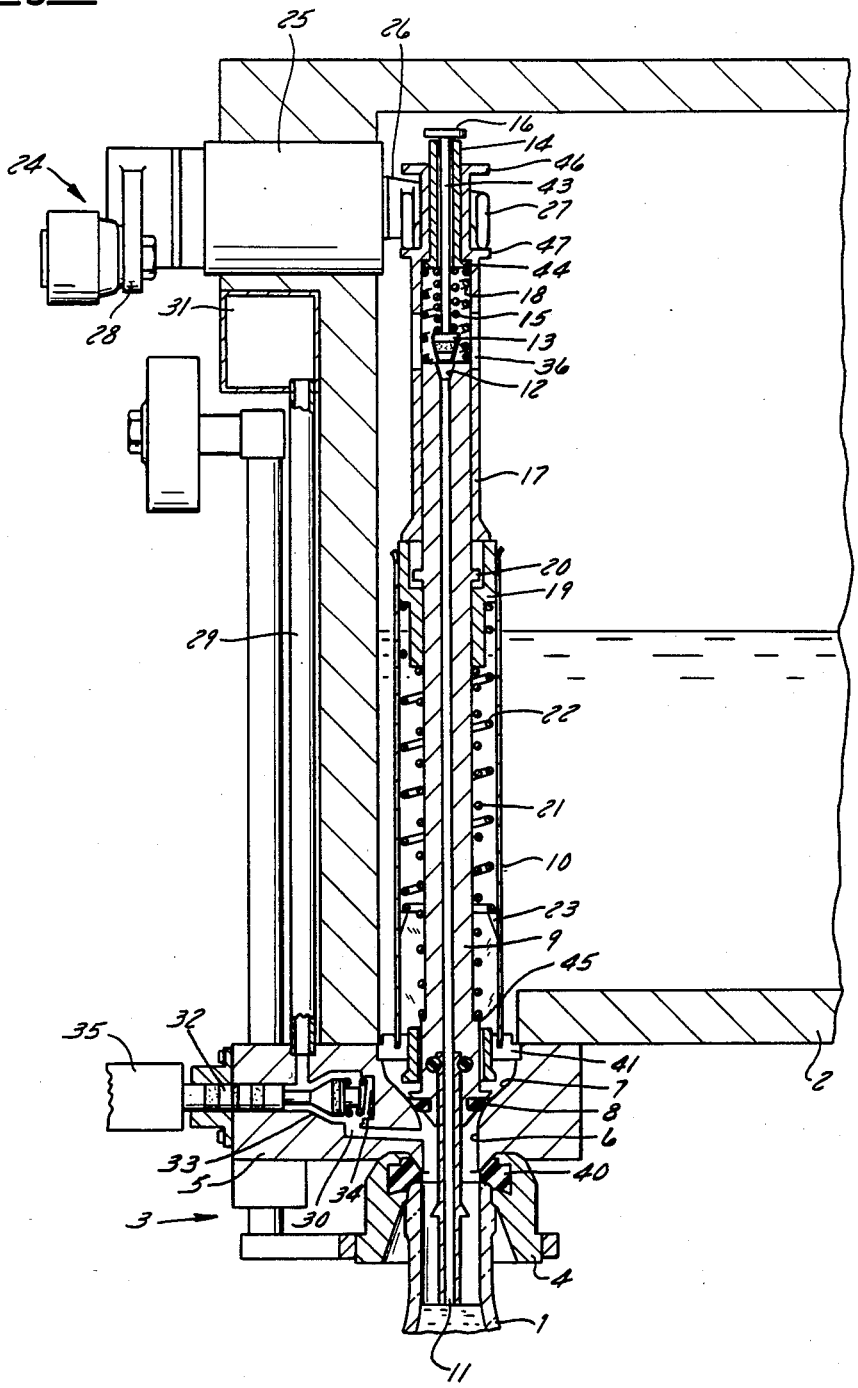
FIG. 1 is a vertical partial section of the improved container filling device.
Figure 2:
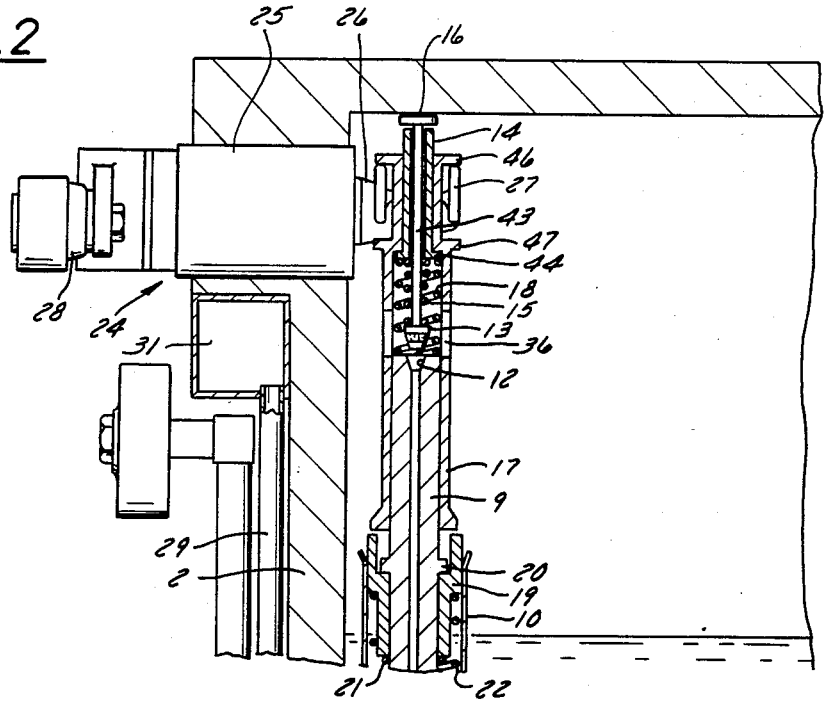
FIG. 2 is a partial section of the filling device showing the parts as they are disposed during fluid filling.
Figure 3:
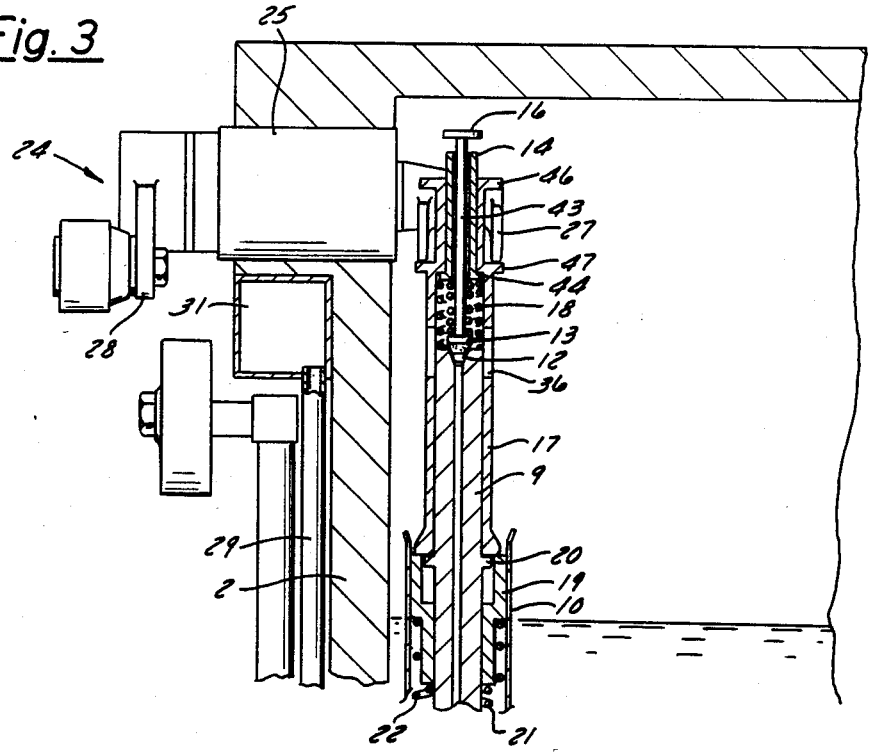
FIG. 3 is a vertical partial section of the filling device showing how the parts are disposed when the device is completely shut down.

The container filling device according to FIGS. 1–3 is especially efficacious for bottling oxygen sensitive liquids, such as wine, under above atmospheric counterpressure conditions. The device can fill several different container types with fluid but is illustrated as being adapted to fill bottles 1. The filling apparatus comprises a rotationally symmetric tank 2 which can rotate about a central vertical axis. Tank 2 contains a quantity of liquid and there is pressurized gas, such as carbon dioxide, above the surface of the liquid. The liquid level and pressure in the tank 2 are held constant by means of conventional regulating equipment, not shown. Several filling stations 3 are arranged in a circle about tank 2 although only one such station 3 is shown. Rotating synchronously with filling station 3 is a lift mechanism, not shown, by means of which bottle 1 can be pressed in gas and liquid tight relationship with an annular rubber seal 40 which is in a centering cap 4.

Each filling station 3 contains a block 5 which is fastened to the under side of tank 2 in line with an opening in the bottom of the tank. A cage 41 is anchored in the hole and it has apertures, not visible, for allowing liquid to flow out of the tank. Block 7 has a through-hole comprised of a neck portion 7 and an outlet 6 which leads to the container bottle 1 being filled. Neck 7 is contoured to serve as the seat for the fluid valve disk or gasket 8. Valve disk 8 is mounted on a vertically movable gas exchange tubular member 9 which has a long central bore. The tubular member 9 also serves as the fluid valve stem. Gas conducting tube 9 has an extension which extends through outlet 6 and terminates in an open tip 11 within the bottle 1 which is undergoing filling. The rim of the tube around the tip 11 opening determines the filling height. Tubular member 9 conducts gas bidirectionally, that is, from the tank to the container that is to be filled and from the container back to the tank as gas in the container is displaced by liquid. The upper end of gas return tube 9 has a cone shaped opening 12 which constitutes the seat of a correspondingly shaped gas valve disk 13 which is supported on a stem 43. The disk and stem are collectively called the stem herein on occasion and in the claims. The gas valve disk 13 and its stem 43 are concentric with gas conducting tubular member 9 and guided for vertical movement in a bushing 14. There is a compression spring 15 inserted between the lower flange 44 of bushing 14 and the top of valve disk 13. Spring 15 tends to press disk 13 downwardly against conical valve seat 12. The lowest limit of movement of the gas valve stem 43 is determined by the position of a stop head 16 on the end of valve stem 43. The vertically movable gas valve stem 43 and 13 in bushing 14 and the effect of compression spring 15 provides for the task of evening out height tolerances in forcibly closing the gas valve 12, 13 and assures adequate closing force under all circumstances.

Bushing 14, valve stem 43, valve disk 13 and compression spring 15 are guided in a tube-like control member 17 which has lateral openings 36 for conducting gas out of and back into tank 2.

Between the lower end of bushing 14 and the upper end of gas conducting tubular member 9 there is a relatively weak compression spring 18 which tries to push bushing 14 upward. The uppermost end position of bushing 14 in relation to control member 17 is determined by an annular stop flange 44 at the lower end of bushing 14. In the normal control of gas valve 13 through the agency of control member 17, compression spring 18 participates only to the extent that keeps the flange 44 on bushing 14 always up against the control member 17. If a container should break during the filling operation gas valve disk 13 will be pushed by the sudden escape of pressurizing gas against the force of compression spring 18 and the gas valve will thereby close automatically.

Below the control member 17 there is a tubeshaped stop 19 which is guided and is axially movable on gas conducting tubular member 9. The upper end position limit of tubular stop 19 relative to return gas tube 9 is determined by an annular radially extending shoulder 20 on the outside of return gas tube 9. Between tubular stop 19 and a shoulder 45 near the bottom of the return gas tube 9, there is a compression spring 21 which tries to press tubular stop 19 against the annular shoulder 20 on gas tube 9. Another compression spring 22 acts on the tubular stop shoulder 19 and is supported further down by ears 23 in guide bushing 10 for the return gas tubular member 9. Compression spring 22 tries to lift the fluid valve disk 8 off its seat 7. The return gas tube 9 serves as a push rod for opening fluid valve 7, 8.

One function of control member 17 is to control the height position of the gas valve stem 43 and its valve disk 13. Another function is to act as a fluid valve stem 8 by way of its lower rim, either directly over annular shoulder 20 on return gas tube 9, if within its reach or by way of tubular stop 19 and compression spring 21 as intermediaries. The height position of control member 17 itself is determined by a single actuating mechanism 24. The actuating mechanism comprises a bushing 25 arranged in the side wall of tank 2 and a control shaft 26 which has a gas-tight and self-braking bearing. On the end of control shaft 26 inside of tank 2 a fork 27 is fastened which engages in a groove defined by radially extending flanges 46 and 47 on the control member. On the end of control shaft 26 outside of tank 2 a roller lever 28 is fastened. As tank 2 rotates, this roller lever will be slewed by fixed control dogs, not shown, or curved track, not shown, and held in position by self-braking between bushing 25 and control shaft 26.

Within block 5 of filling station 3 and with an adjoining length of tubing 29, a conduit 30 is formed which on one end opens below the seat 7 into outlet 6 and on the other end into an annular channel 31. Channel 31 is fastened to tank 2 and filled with carbon dioxide gas at above atmospheric pressure. Inserted into line 30 is a check valve having a push rod 32 guided in block 5 and its sealing part mated to a conical seat 33. The sealing part on push rod 32 is pressed by a compression spring 34 against its seat 33 such that the check valve 32, 33 is normally closed.

During a rotation of tank 2 and at a certain point in its circumferential travel, valve stem 32 is pressed briefly into block 5 by means of a stationary curved track 35 causing the sealing part to be lifted off seat 33 and allowing carbon dioxide gas to flow out of annular channel 31 into outlet 6 and bottle 1 which is pressed against filling station 3.

The function of the container filling device described above will now be described. At the start tank 2, of course, is filled to the indicated predetermined height with the liquid to be dispensed. Carbon dioxide gas above the liquid in the tank is pressurized to 2 bars, for example, and the annular channel 31 is pressurzied with carbon dioxide gas under a pressure 2.1 bars. When the filler device it orbiting on tank 2 through a zone where no container is lifted to the device the control member 17 is held in its lowermost position by actuating mechanism 24 as in FIG. 3. In that situation, control member 17 presses gas conducting tubular member 9 down by way of the lower flange on the control member and the annular shoulder 20, whereby fluid valve stem 8 is pressed firmly against its seat 7 and fluid valve 7, 8 is forced closed. Simultaneously, the gas valve stem, particularly valve disk 13, is pressed firmly against its seat 12 by control member 17 acting through bushing 14 and compression spring 15 and, therefore, gas valve 12, 13 is forced closed.

As a bottle 1 is pressed by a lift mechanism, not shown, against sealing ring 40, control member 17 is pushed to its upper end position by operating mechanism 24 and held there as in FIG. 2. The gas valve disk 13 is thereby lifted off its seat 12 by way of bushing 14 and stop head 16 and thus the gas valve 12, 13 is forced open. Opening occurs independently of the pressure levels in tank 2 and annular channel 31. Simultaneously, the lower rim of control member 17 lifts off shoulder 20 on the gas return valve and shoulder 19 which is moved by compression spring 21 against shoulder 20. The gas conducting tubular member 9 is thereby set free. Due to the pressure difference between tank 2 and the bottle however, gas tube 9 still remains in its lower end position and keeps fluid valve 7, 8 closed until pressure equalization between tank 2 and bottle 1 is reached by the carbon dioxide gas flow from tank 2 into bottle 1 through gas valve 12, 13 and return gas tube 9. Thereupon the gas tube 9 is lifted by the appropriately dimensioned compression spring 22 by way of shoulder 19 and annular shoulder 20 and the fluid valve 7, 8 is thereby opened automatically. Compression spring 21 does not participate in this event. The upper end position of the gas tube 9 is, for example, defined by the lower rim of bushing 10 serving as a stop in coordination with fluid valve stem 8.

The liquid now flows out of tank 2 through its bottom opening, the open fluid valve 7, 8 and the outlet 6 into bottle 1 with the pressurizing gas flowing through return gas tube 9 back into tank 2. This process is automatically interrupted when the liquid in bottle 1 has reached the height of tip opening 11 in the return gas tube 9 so the gas tube is closed off. Because of an undefined end of flow of liquid during which the pressurizing gas bubbles directly cover outlet 6 back into tank 2, a filling height establishes itself, which is more or less above the tip opening 11 in return gas tube 9.

At the end of the filling operation proper, control member 17 is shifted into its middle position by actuating mechanism 22 and held there as in FIG. 1. The control member thereby compresses fluid valve stem 8 downward against its seat 7 by acting through its lower end face, shoulder 19, compression spring 21 and the return gas tube 9. Thus, the fluid valve 7, 8 is forcibly closed. The gas valve disk 13 is lowered at the same time and brought somewhat closer to its seat 12 but is not pressed against it. The gas valve 12, 13 remains, therefore, forcibly opened. At this state, with the fluid valve 7, 8 forced closed and gas valve 12, 13 forced open, check valve 32, 33 is briefly opened by curved track 35. The carbon dioxide gas then flows smoothly and without creating turbulence because it has a pressure of only 0.1 bar greater than the pressure in the bottle. From the annular channel 31 by way of line 30 into outlet 6 and bottle 1. The gas pressure in the bottle which now exceeds the tank pressure forces the liquid above opening 11 through the opening and through return gas tube 9 and the mechanically forced open gas valve 12, 13 back into tank 2. The liquid and carbon dioxide gas following it do not have to pass any choking restrictions in that process and escape slowly from the open gas valve 12, 13 into tank 2. In this gentle correction of the filling height no disturbance of the liquid in the bottle 1 and tank 2 occurs nor is there any entrapment of significant quantities of liquid from a level below opening 11.

After blocking valve 32, 33 has been closed, the control member 17 is lowered by actuating mechanism 24 from its middle position as in FIG. 1 into its lower end position as in FIG. 3 and held there. In that phase, gas valve disk 13 is pressed firmly against its seat 12 by way of bushing 14 and compression spring 15 and, thereby, gas valve 12, 13 is forcibly closed. After this, the pressure in the properly filled bottle 1 can be lowered to atmospheric value by means of a relief valve, not shown, and bottle 1 can be removed from the filling station 3.

I claim:

1. A counterpressure container filler having a tank for containing liquid and gas under pressure and a container filling device, said device including, a body having a passageway for conducting liquid from said tank to a container that is to be filled, a gas conducting tubular member for conducting gas bidirectionally between said tank and container, said member terminating in the container with an opening at the level to which the container should be filled, a fluid valve for controlling the flow of liquid through said passageway from said tank to said container, a gas valve for controlling the flow of gas through said tubular member, a source of gas at a pressure slightly higher than the pressure in said tank and a check valve through which said source is coupled to said passageway, control means operative to keep said gas valve forced open after said container has been filled to said level or above said level independently of pressure conditions in the said tank and container, and means for opening said check valve momentarily for injecting pressurized gas from said source into said passageway and container while said gas valve is still held open for said gas to force any liquid above said level in the container out through said tubular member and into said tank before said gas valve is closed.

2. The container filling device according to claim 1 wherein said control means is operative to open said gas valve at the start of the container filling operation and to keep said gas valve forced open until said check valve opens and to close said gas valve after said check valve is closed.

3. The container filling device according to any one of claims 1 or 2 wherein said control means is adapted to forcibly close said fluid valve simultaneously while forcibly holding said gas valve open.

4. The container filling device according to claim 1 wherein:

there is a seat for said fluid valve in said passageway, said gas conducting tubular member has an upper end in said tank terminating in a seat comprising said gas valve and near the lower end of said tubular member there is a fluid valve disk for cooperating with said seat of the fluid valve in said passageway, said control means including a generally cylindrical member concentric with said upper end of said tubular member and a valve stem extending axially through said cylindrical member and cooperating with the seat of the gas valve in said tubular member, a tubular stop element arranged concentrically to said tubular gas conducting member and slidable axially thereon, a shoulder on said gas conducting tubular member located more remotely from said upper end than said generally cylindrical member and, a compression spring interposed between said a shoulder and said generally cylindrical member for said generally cylindrical member to be supported by said spring so that some downward movement of said gas conducting member will move said gas valve stem nearer to its seat and said fluid valve disk into engagement with its seat and that further downward movement of said generally cylindrical member needed for fully closing said gas valve is absorbed by said compression spring.

5. The container filling device according to claim 4 including a generally annular shoulder formed on the said gas conducting tubular member in alignment with said stop element for determining the upper limit of movement of said stop element.

6. The container filling device according to any one of claims 4 or 5 including a spring surrounding said gas valve stem within said generally cylindrical member for being compressed by said generally cylindrical member as said gas valve stem is pressed against its seat.

7. The container filling device according to claim 4 including a bushing movably guided in said generally cylindrical member, said gas valve stem being axially movable in said bushing, a compression spring interposed between said upper end of said gas conducting tubular member and said bushing, the characteristic of said spring being such that if there is an unimpeded flow of gas through said gas valve such as due to breakage of a container the effect will be to overcome the force of said spring and close said gas valve automatically.

* * * * *